US008068035B1

(12) United States Patent
Salcedo et al.

(10) Patent No.: US 8,068,035 B1
(45) Date of Patent: Nov. 29, 2011

(54) WEATHER-PROOF AND TAMPER-PROOF AUDIO/VIDEO DISPLAY SYSTEM AND ASSOCIATED HOUSING FOR OUTDOOR USE

(76) Inventors: Bronson Salcedo, Houston, TX (US); Kenneth Oliver, Missouri City, TX (US)

( * ) Notice: Subject to any disclaimer, the term of this patent is extended or adjusted under 35 U.S.C. 154(b) by 1693 days.

(21) Appl. No.: 11/327,759

(22) Filed: Jan. 9, 2006

(51) Int. Cl.
*G08B 5/00* (2006.01)

(52) U.S. Cl. ..... 340/691.1; 340/541; 340/540; 340/384.1; 340/815.4; 320/101; 715/704

(58) Field of Classification Search ..... 340/540, 340/541, 384.1, 815.4; 320/101; 715/704
See application file for complete search history.

(56) References Cited

U.S. PATENT DOCUMENTS

| | | | | |
|---|---|---|---|---|
| 6,338,211 | B1 | 1/2002 | Carney | |
| 6,637,911 | B2 | 10/2003 | Sittner | |
| 6,980,107 | B1 * | 12/2005 | Ziegler | 340/540 |
| 2005/0204300 | A1 * | 9/2005 | Mindrum | 715/764 |
| 2006/0075343 | A1 * | 4/2006 | Henry | 715/704 |
| 2006/0236326 | A1 * | 10/2006 | Aguirre | 719/322 |
| 2008/0143292 | A1 * | 6/2008 | Ward | 320/101 |

OTHER PUBLICATIONS

Vidstone Panel www.vidstone.com.

* cited by examiner

*Primary Examiner* — Brian Zimmerman
*Assistant Examiner* — Kaleria Knox

(57) ABSTRACT

A weather and bullet proof display system includes a casing that is nested within a headstone and has an opening formed therein. Solar panels are mounted on the headstone. A bullet proof shield is conjoined to the casing within the opening. A display screen is disposed behind the shield. A mechanism for converting solar energy to electrical energy is coupled to the solar panels and housed within the casing. A 12-volt rechargeable battery is coupled to the energy converting mechanism. A mechanism is included for converting a first DC voltage input level to a second DC voltage level, which is coupled to the solar energy converting mechanism. A system board is coupled to the DC voltage level converting mechanism and includes a mechanism for contemporaneously emitting a prerecorded audio and video output. Speakers are nested within the headstone and are coupled to the DC voltage level converting mechanism.

12 Claims, 9 Drawing Sheets

WEATHER-PROOF AND TAMPER-PROOF AUDIO/VIDEO DISPLAY SYSTEM AND ASSOCIATED HOUSING FOR OUTDOOR USE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to audio/video display systems and, more particularly, to a weather-proof and tamper-proof audio/video display system and associated housing for outdoor use.

2. Prior Art

It is well known in the prior art that the loss of a loved one is conventionally commemorated by erecting a grave stone at the head of the deceased's grave. Such a grave stone usually consists of a slab of marble, or other durable stone material, that has been appropriately shaped and normally includes the deceased person's name, date of birth, date of death, and a fond commemorative saying, like "Will be dearly missed by family and friends". Once the grave stone is erected other persons walking through the grave yard can know who is resting there by looking at the grave marker.

Often, though, a person's family feels that the space provided on a conventional grave marker is far too limited to properly convey the true nature and extent of the deceased's life. A prior art grave stone marker or tombstone is known that visually identifies the resting place of the remains of a once living person. In addition to the conventional written information applied thereto, the marker also includes an audio system that can audibly broadcast information relevant to or regarding the identified remains.

Although such an audio grave marker provides means to convey additional information about the deceased person, there still various drawbacks and limitations thereto. For one, the photovoltaic cells used to power the audio means of this example are placed in a location that does not allow for optimal exposure to the rays of the sun, thus the audio means is not sufficiently powered at all times. Another drawback of the above mentioned grave marker, and conventional grave markers, is the inability to convey video clips of the deceased to persons passing by.

Accordingly, a need remains for a weather-proof and tamper-proof audio/video display system and associated housing for outdoor use in order to overcome the above-noted shortcomings. The present invention satisfies such a need by providing an audio/video display system that is easy and convenient to use, is durable in design, and allows a person's loved ones to properly celebrate their life. Such an audio/video display system has the ability to resist both onslaughts from the elements as well physical tampering from delinquent individuals.

BRIEF SUMMARY OF THE INVENTION

In view of the foregoing background, it is therefore an object of the present invention to provide a weather-proof and tamper-proof audio/video display system and associated housing for outdoor use. These and other objects, features, and advantages of the invention are provided by an audio/video display system for playing back a prerecorded electronic file over extended periods of time at a cemetery.

The display system includes a stainless steel casing that is directly connected to an existing headstone positioned on a ground surface adjacent to a burial plot in the cemetery. Such a casing is nested within the headstone such that a front edge of the casing is mounted flush with a front face of the headstone. The casing has a substantially rectangular shape and is provided with a central opening formed therein. The stainless steel casing preferably includes a first section that is positioned forward of the bullet proof shield. A second section is detachably positioned rearward of the DC voltage level converting mechanism. Such a second section has a central opening formed therein and is provided with a bracket that is directly mounted to an inner perimeter of the opening for effectively receiving and supporting the system board at an elevated position.

A plurality of solar panels are directly and permanently mounted on an exterior surface of the headstone. Such solar panels are selectively spaced apart and positioned in such a manner that the solar panels face a projected path of daylight sun rays. The solar panels are disposed to an exterior of the casing.

A bullet proof shield is directly conjoined to the casing and interfitted within the opening in such a manner that unauthorized access to an interior of the casing is advantageously and effectively prohibited. Such a bullet proof shield is adhesively connected to the casing. A display screen is disposed rearward of the shield and faces outwardly towards the front face of the headstone.

A mechanism is included for converting a solar energy input to an electrical energy output. Such a solar energy converting mechanism is electrically coupled to the solar panels and is housed within the casing. A 12-volt rechargeable battery is electrically coupled directly to the solar energy converting mechanism so that the 12-volt rechargeable battery can conveniently and effectively be replenished with power during non-operating conditions.

A mechanism is included for converting a DC voltage input having a first voltage level to a DC voltage output that has a second voltage level. Such a DC voltage level converting mechanism is electrically coupled to the solar energy converting mechanism and spaced from the 12-volt rechargeable battery such that the DC voltage level converting mechanism is independently operable from the 12-volt rechargeable battery. The DC voltage level converting mechanism preferably includes a DC-to-DC controller which converts a 12-volt input signal to a 5-volt output signal for effectively powering the system board and the LCD panel respectively. A plurality of speakers are nested within the headstone and are electrically coupled to the DC voltage level converting mechanism.

A system board is electrically and directly coupled to the DC voltage level converting mechanism. Such a system board includes a mechanism for contemporaneously emitting an audio output and an associated video output based upon a prerecorded electronic file stored on the system board. The display system is weatherproof and bullet proof for advantageously and effectively preventing unauthorized access thereto.

The system board preferably includes a processor, an audio and video playback device embedded on an architecture of the system board and electrically coupled to the processor, and a memory electrically coupled to the processor. Such a memory includes software instructions that causes the display system to selectively play back the prerecorded electronic file as desired by a user. The software instructions execute the steps of identifying an input signal received from an external user input, generating and sending a first control signal to the audio and video playback device such that the prerecorded electronic file is caused to play on demand, and generating and sending a second control signal to the solar energy converting mechanism such that an energy supply source can be regulated when the user desires to turn off the audio and video playback device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
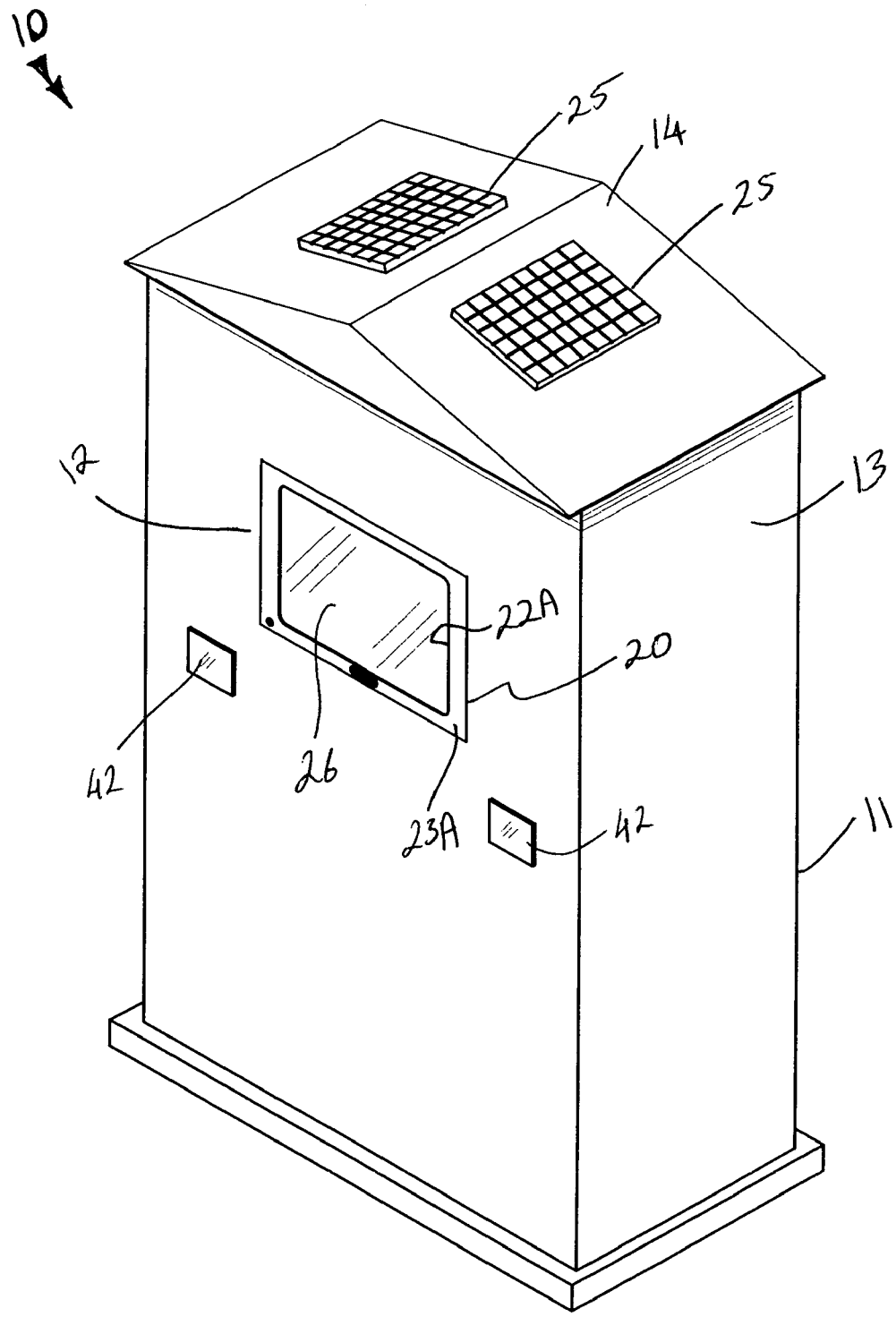
FIG. 1 is a front-perspective view showing a weather-proof and tamper-proof audio/video display system and associated housing for outdoor use, in accordance with the present invention.
Figure 2:
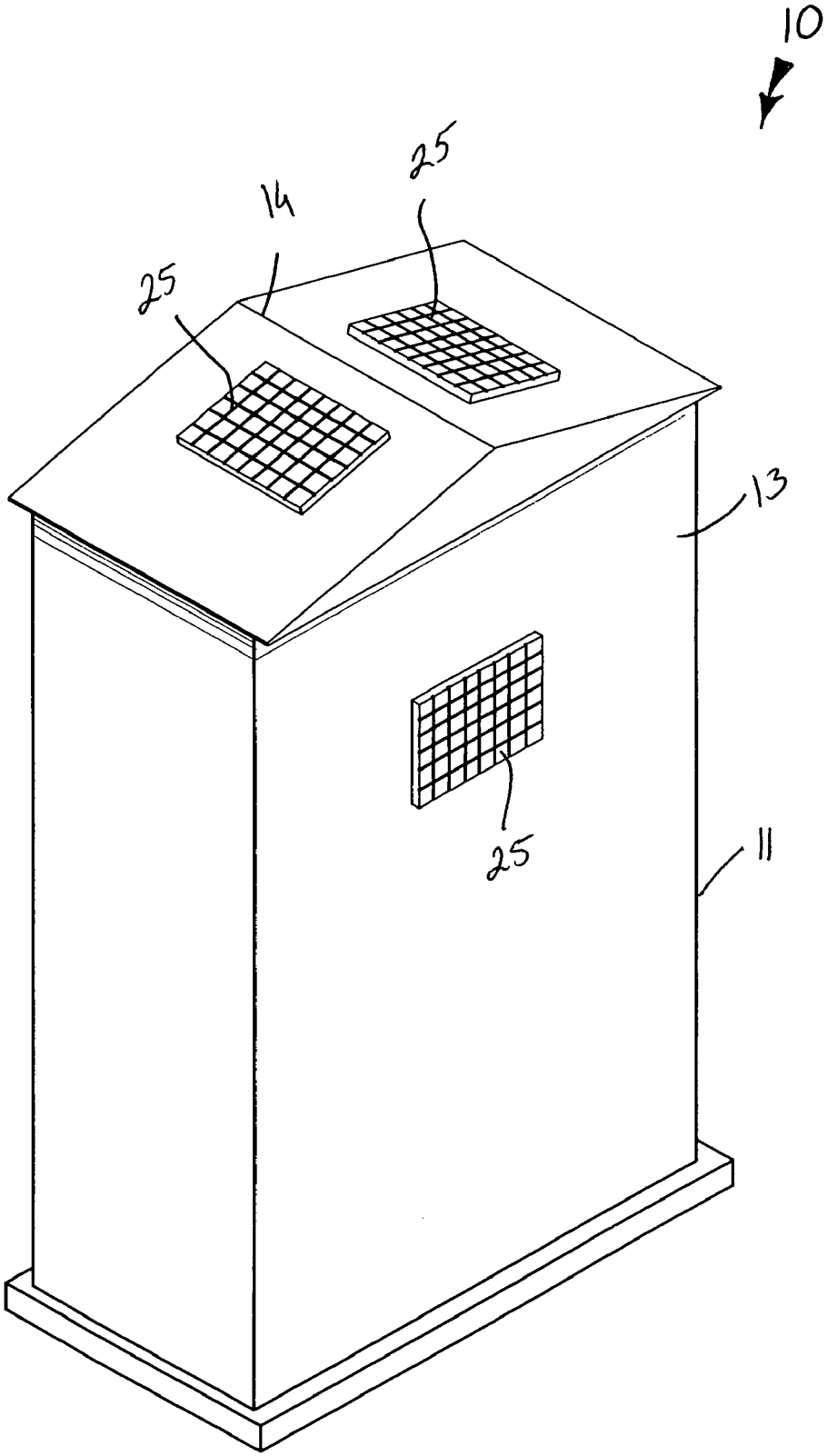
FIG. 2 is a rear-perspective view of the system shown in FIG. 1.
Figure 3:
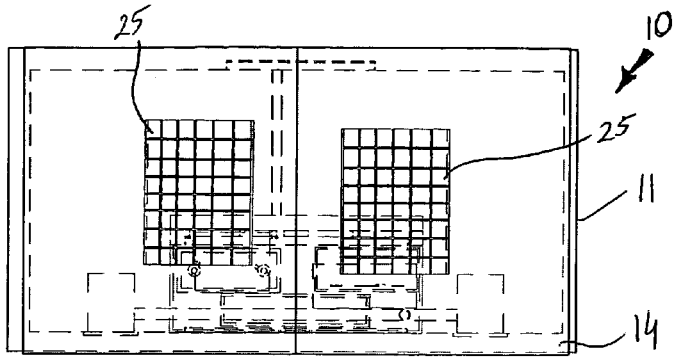
FIG. 3 is a top plan view of the system shown in FIG. 1.
Figure 4:
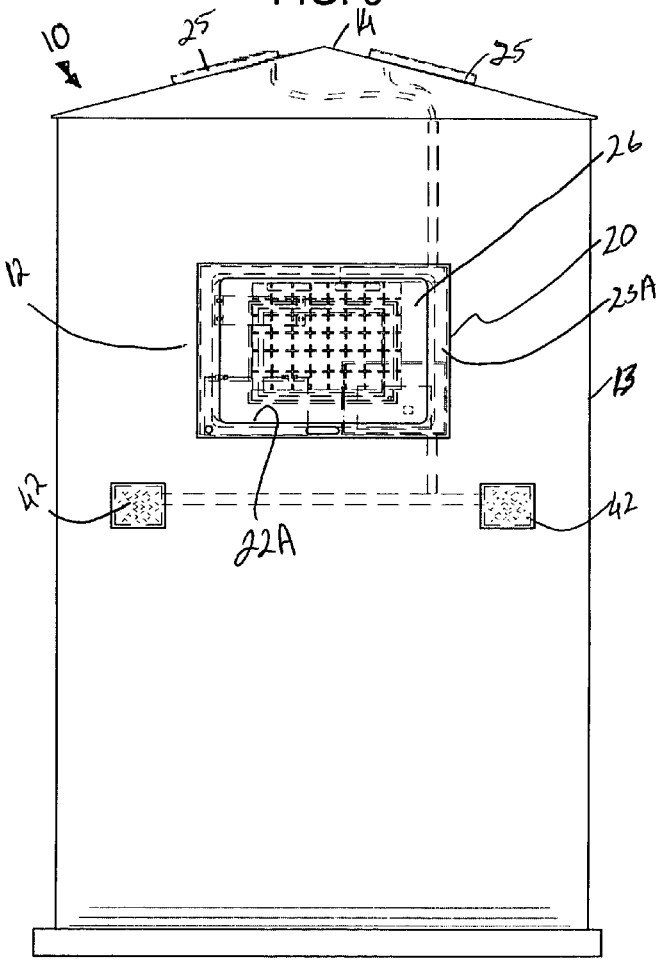
FIG. 4 is a front-elevational view of the system shown in FIG. 1.
Figure 5:
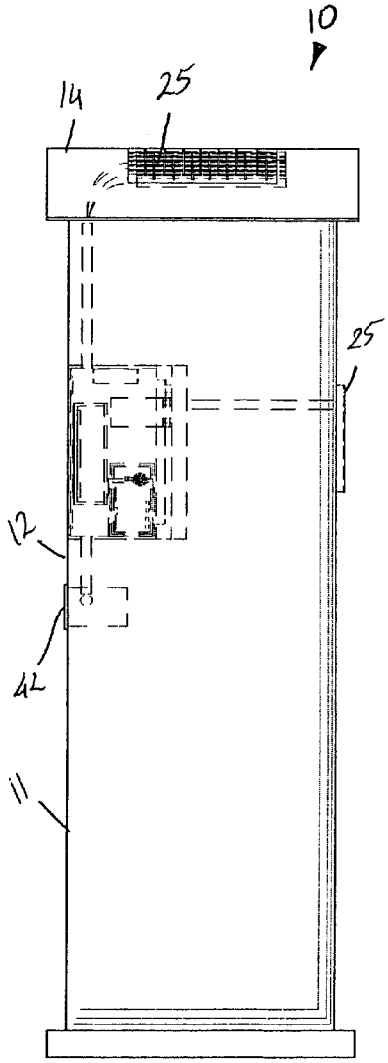
FIG. 5 is a side-elevational view of the system shown in FIG. 1.
Figure 6:
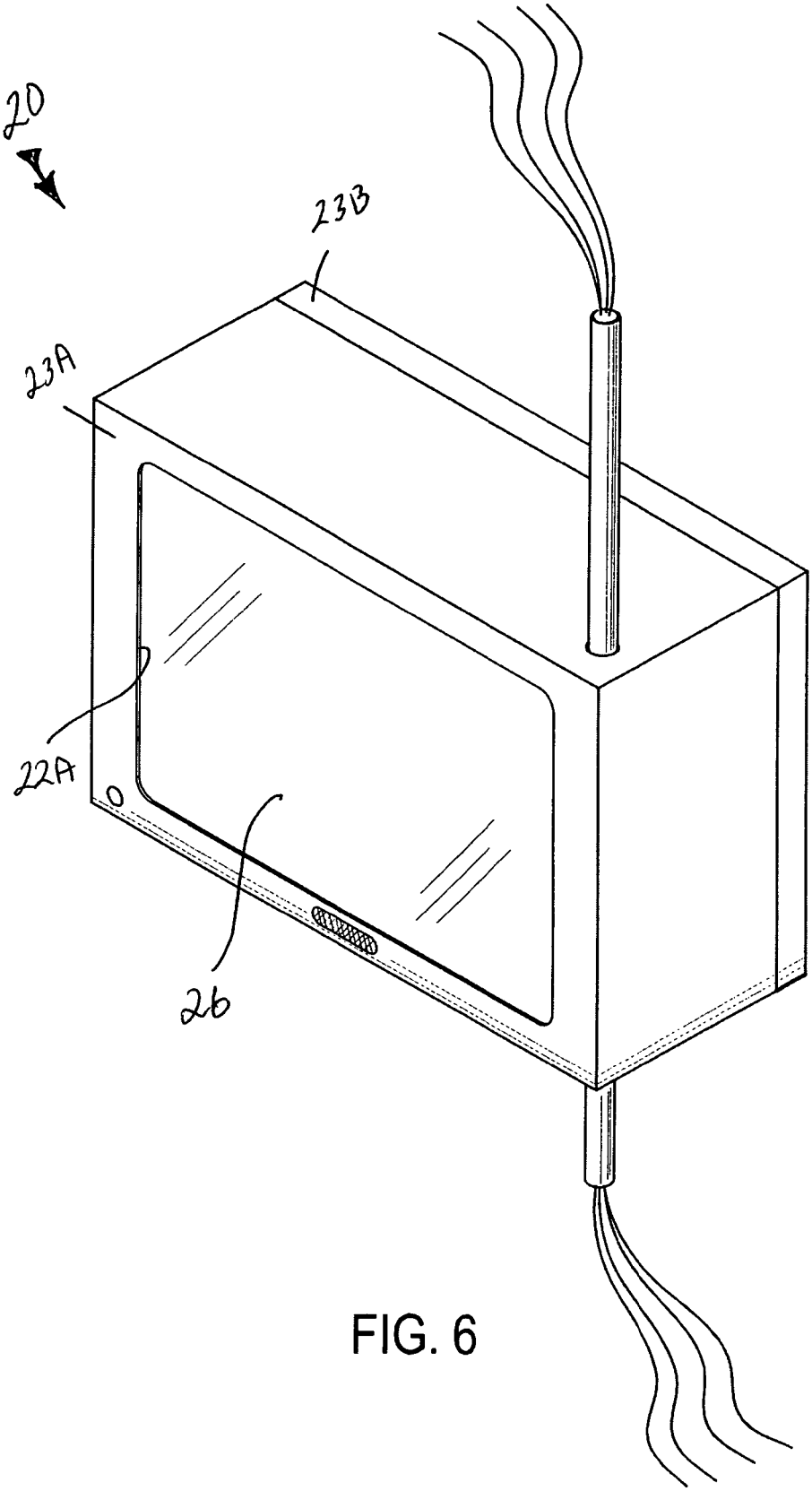
FIG. 6 is an enlarged perspective view of the casing shown in FIG. 1.
Figure 7:
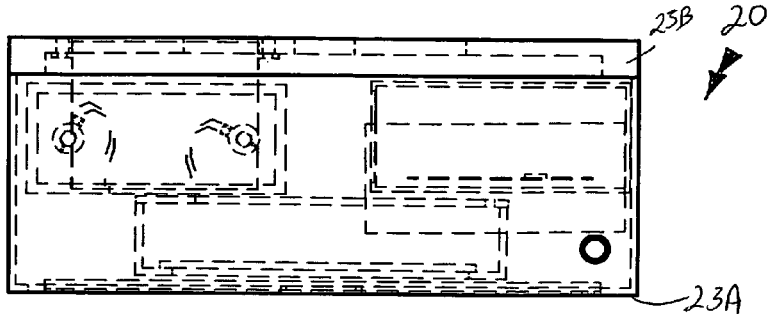
FIG. 7 is a top plan view of the casing shown in FIG. 6.
Figure 8:
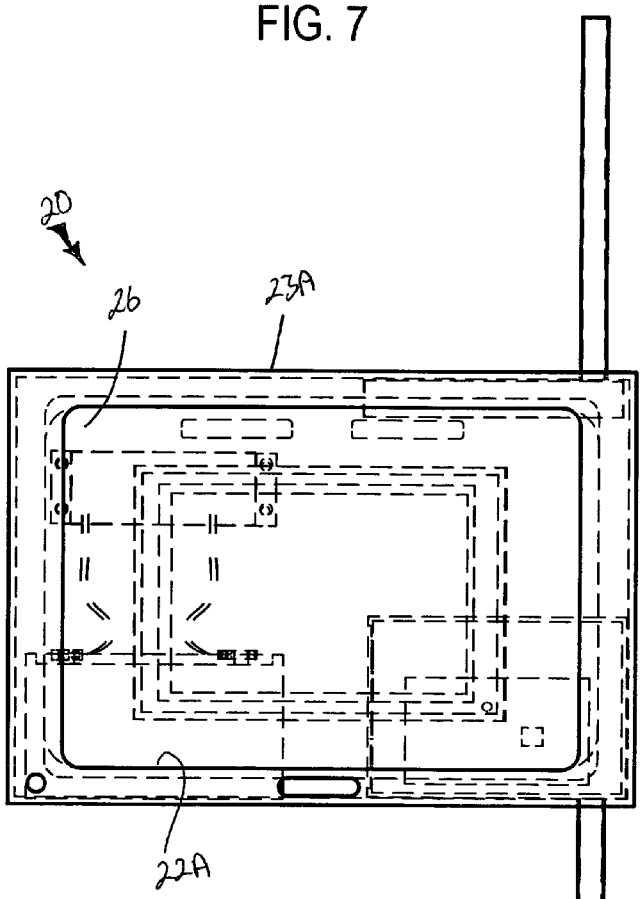
FIG. 8 is a front-elevational view of the casing shown in FIG. 6.
Figure 9:
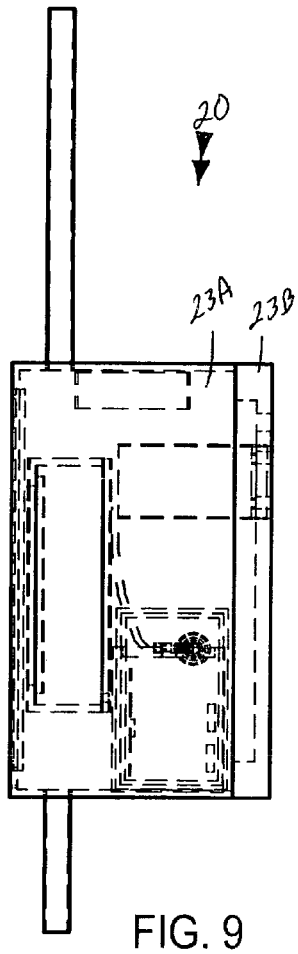
FIG. 9 is a side-elevational view of the casing shown in FIG. 6.
Figure 10:
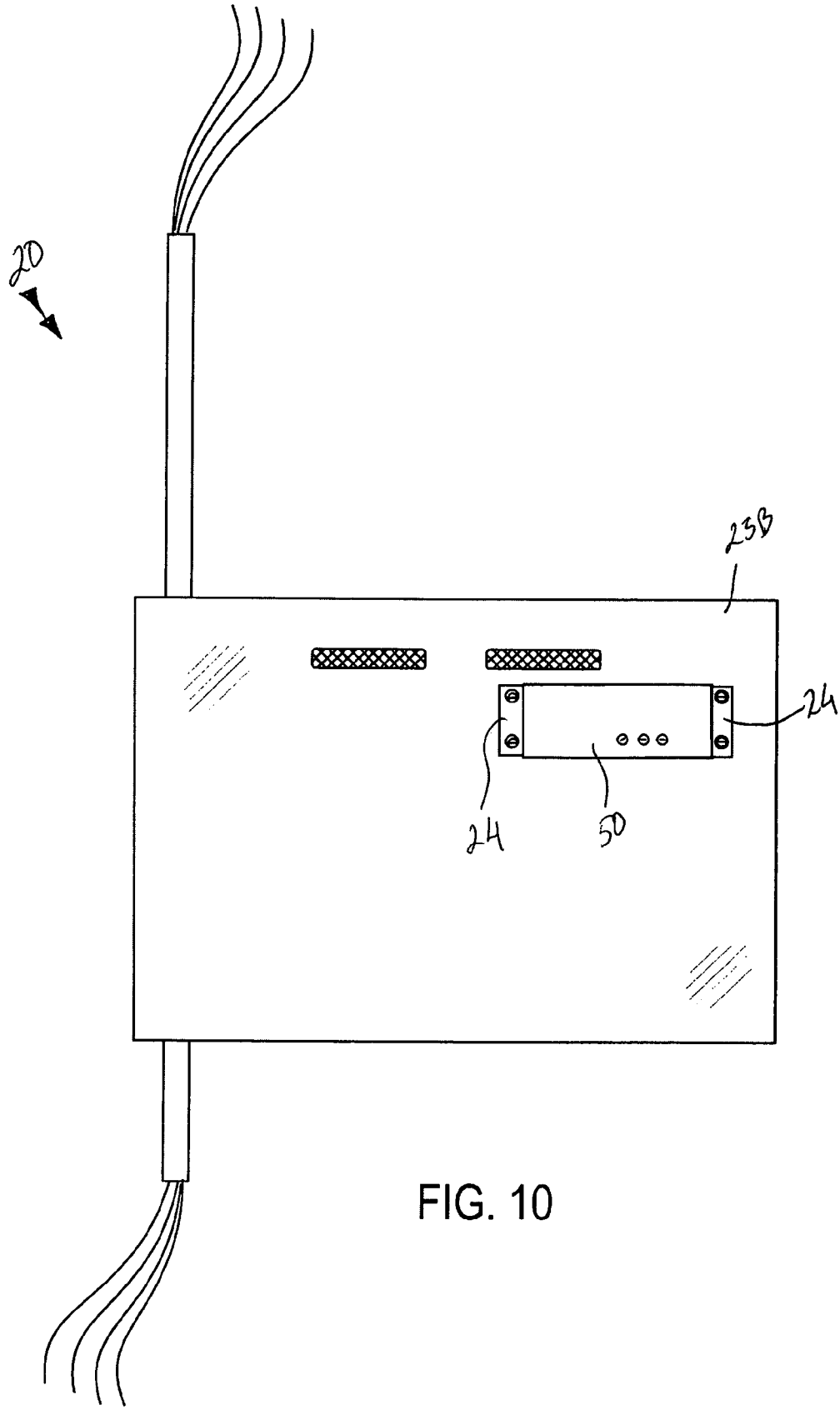
FIG. 10 is a rear-elevational view of the casing shown in FIG. 6.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1-13 by the reference numeral 10 and is intended to provide a weather-proof and tamper-proof audio/video display system and associated housing for outdoor use. It should be understood that the system 10 may be used to provide an audio and video output in many different types of applications and should not be limited in use to only grave headstones.

Referring initially to FIGS. 1, 4, 6, 7, 8, 9, 10, and 12, the system 10 includes a stainless steel casing 20 that is directly connected, without the use of intervening elements, to an existing headstone 11 positioned on a ground surface adjacent to a burial plot in the cemetery. The stainless steel construction of the casing 20 is essential for providing protection to the items housed therein from the harsh environmental conditions. Such a casing 20 is nested within the headstone 11 such that a front edge 21 of the casing 20 is mounted flush with a front face 12 of the headstone 11. Of course, the casing 20 may be nested within a variety of different burial markers such as mausoleums, conventional headstones, or flat plate style markers, as is obvious to a person of ordinary skill in the art.

The casing 20 has a substantially rectangular shape and is provided with a central opening 22A formed therein. Of course, the casing 20 may be produced in a variety of alternate shapes and sizes, as is obvious to a person of ordinary skill in the art. The stainless steel casing 20 includes a first section 23A that is positioned forward of the bullet proof shield 26 (described herein below).

A second section 23B is detachably positioned rearward of the DC voltage level converting mechanism 40 (described herein below). Such a second section 23B has a central opening 22B formed therein and is provided with a bracket 24 that is directly mounted, without the use of intervening elements, to an inner perimeter of the opening 22B, which is crucial for effectively receiving and supporting the system board 50 (described herein below) at an elevated position.

The present invention may also include a plurality of multiple point locks for securing the casing 20 to the granite slab. Suitable security locks may be found on www.illinoislock.com and www.medeco.com. In a preferred embodiment, a plurality of vents or openings (not shown) can be provided for ventilating air and dust during extended periods of time.

Referring to FIGS. 1, 2, 3, 4, 5 and 12, a plurality of solar panels 25 are directly and permanently mounted, without the use of intervening elements, on an exterior surface 13 of the headstone 11. Such solar panels 25 are selectively spaced apart and positioned in such a manner that the solar panels 25 face a projected path of daylight sun rays. Positioning the solar panels 25 on an outer top surface 14 of the headstone 11 advantageously ensures that the solar panels 25 are constantly exposed to the sun's rays through out the course of a day, allowing for optimum recharging capabilities. The solar panels 25 are disposed to an exterior of the casing 20. Conventional solar panels may be employed as long as they are operable with the solar energy converting mechanism 30, described hereinbelow.

Referring to FIGS. 1, 6, 11 and 12, a bullet proof shield 26 is directly conjoined, without the use of intervening elements, to the casing 20 and is interfitted within the opening 22A in such a manner that unauthorized access to an interior of the casing 20 is advantageously and effectively prohibited. Such a bullet proof shield 26 is adhesively connected to the casing 20, which is critical and advantageous for ensuring that fluids and other debris are not allowed to enter the casing 20 along a perimeter of the shield 26. After working with NASA engineers, I was informed Lexan Corporation provides an excellent bullet proof glass that is preferably employed by the present invention. Such a bullet proof glass can be found at www.gelexan.com. Also, the adhesive preferably includes adhesive caulk product #5200 made by 3M Corporation (www.products3.3m.com).

A display screen 27 is disposed rearward of the shield 26 and faces outwardly towards the front face 12 of the headstone 11. It is highly recommended to employ a daylight and sunlight readable open frame flat panel LCD screen having product number LC1502R, which employs a built-in cooling kit as described at www.generaldigital.com. Other daylight, sunlight monitors can also be found on www.planar.com and www.sharpsma.com.

Figure 11:
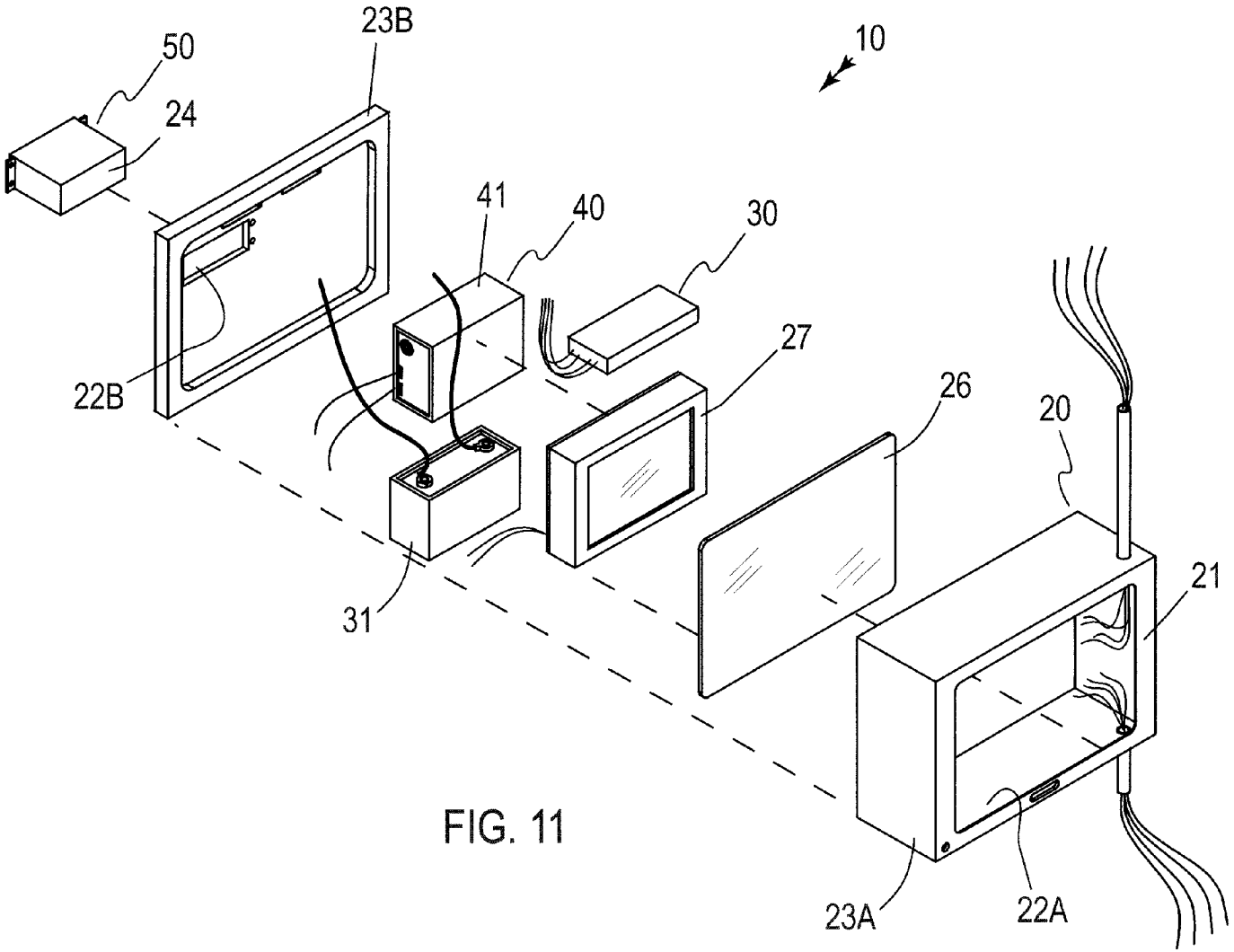
FIG. 11 is an exploded perspective view of the casing shown in FIG. 6.
Figure 12:
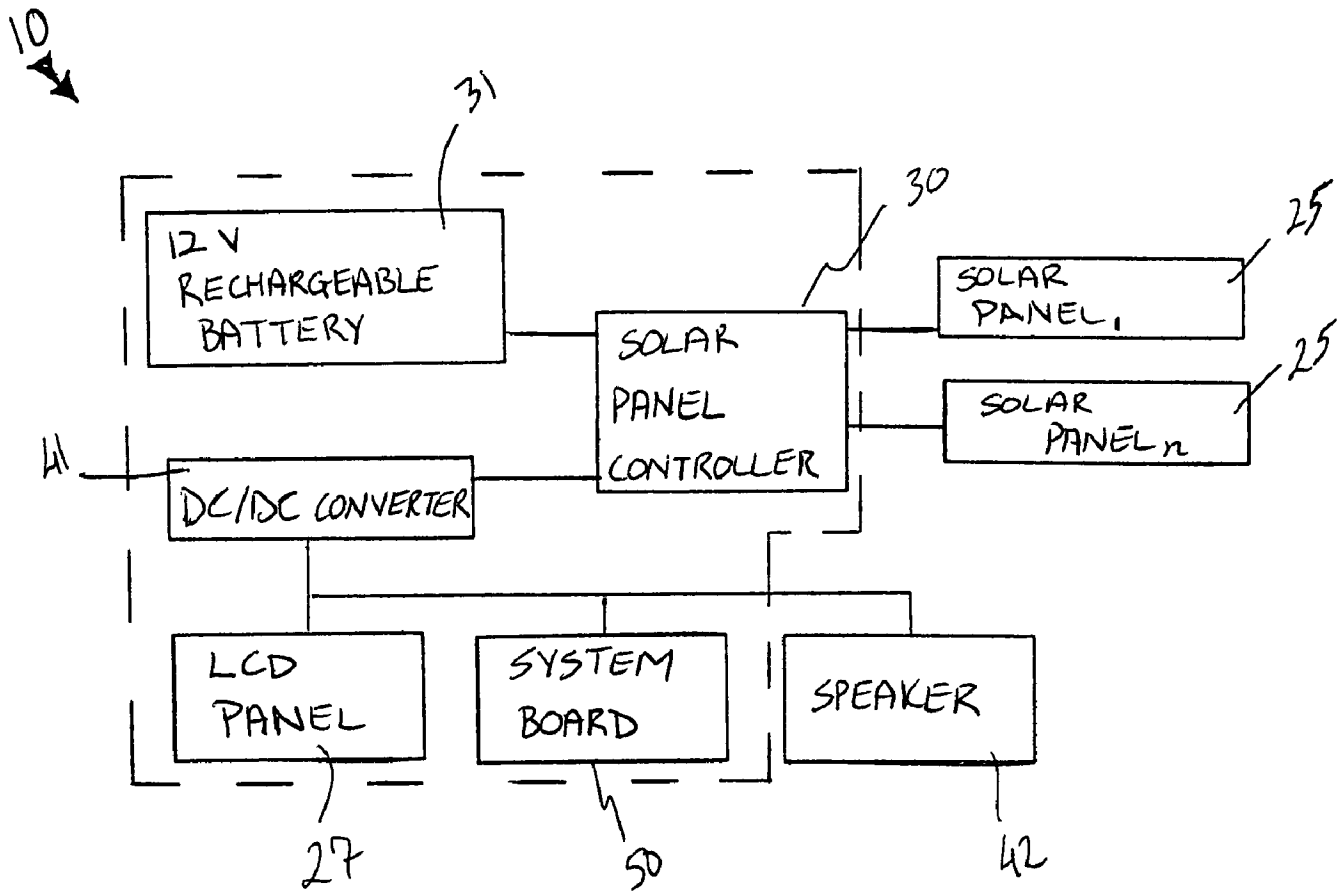
FIG. 12 is a schematic block diagram of the system shown in FIG. 1.

Referring to FIGS. 11 and 12, a mechanism 30 is included for converting a solar energy input to an electrical energy output, thus advantageously eliminating the need for a power source that periodically needs replacement like a non-rechargeable battery (not shown). Such a solar energy converting mechanism 30 is electrically coupled to the solar panels 25 and is housed within the casing 20, which is vital for preventing same from being exposed to harmful environmental elements. A 12-volt rechargeable battery 31 is electrically coupled directly to the solar energy converting mechanism 30, which is essential so that the 12-volt rechargeable battery 31 can conveniently and effectively be replenished with power during non-operating conditions. I recommend employing product number 8GU1, which is a valve-regulated and gelled-electrolyte battery manufactured by MK Battery (www.mkbattery.com). Also, I recommend employ the Sun-Saver Solar Controller sold by Morningstar Corporation because it provides exceptional reliability and is ISO 9002 certified. Morningstar Corporation supplies various models of the controller 30 and can be viewed at www.morningstarcorp.com. Again referring to FIGS. 1, 4, 5, 11 and 12, a mechanism 40 is included for converting a DC voltage input having a first voltage level to a DC voltage output that has a second voltage level. Such a DC voltage level converting mechanism is electrically coupled to the solar energy converting mechanism 30 and is spaced from the 12-volt rechargeable battery 31 such that the DC voltage level converting mechanism 40 is independently operable from the 12-volt rechargeable battery 12. The DC voltage level converting mechanism 40 includes a DC-to-DC controller 41 which converts a 12-volt input signal to a 5-volt output signal, which is a crucial feature for effectively powering the system board 50 and the LCD panel 27 respectively. A plurality of speakers 42 are nested within the headstone 11 and are electrically coupled to the DC voltage level converting mechanism 40. Astrodyne Corporation's 50W single output DC-DC converter is preferably employed because it employs a built-in EMI filter which reduces ripple noise (model number SD-50 found on www.astrodyne.com).

Referring to FIGS. 10, 11, 12 and 13, a system board 50 is electrically and directly coupled, without the use of intervening elements, to the DC voltage level converting mechanism 40. Such a system board 50 includes a mechanism 51 for contemporaneously emitting an audio output and an associated video output based upon a prerecorded electronic file stored on the system board 50. The display system 10 is weatherproof and bullet proof, which is essential and advantageous for effectively preventing unauthorized access thereto.

Figure 13:
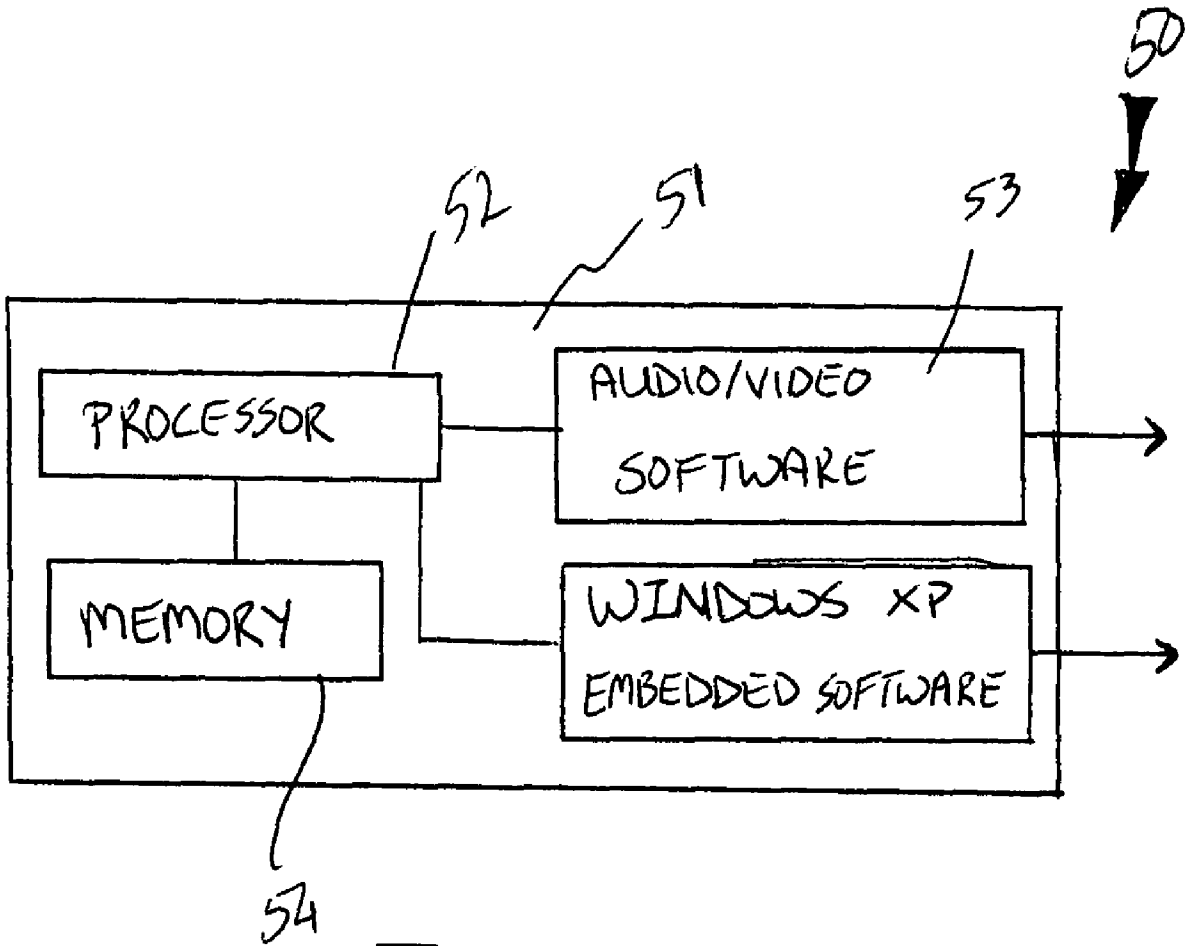
FIG. 13 is a schematic diagram of the system board shown in FIG. 12.

Referring to FIG. 13, the system board 50 includes a processor 52, an audio and video playback device 53 embedded on an architecture of the system board 50 that is electrically coupled to the processor 52, and a memory 54 electrically coupled to the processor 52. Such a memory 54 includes software instructions that causes the display system 10 to selectively play back the prerecorded electronic file as desired by a user. The software instructions execute the steps of identifying an input signal received from an external user input, generating and sending a first control signal to the audio and video playback device 53 such that the prerecorded electronic file is caused to play on demand, and generating and sending a second control signal to the solar energy converting mechanism 30 such that an energy supply source can be regulated when the user desires to turn off the audio and video playback device 53.

It is critical for the present invention to employ ARCOM Corporation's OLYMPUS XP Embedded Development Kit because Windows XP Embedded is already installed on the system and the user only has to download the desired application. Moreover, the Windows XP Embedded operating system is pre-loaded and configured on a 512 Mbyte Compact Flash card, which means the user does not need to use Windows Embedded Studio. Such an advantageous feature overcomes prior art shortcomings of having to program and engineer their operating systems to support the Flash Media platform. Such a development kit also provides all necessary DRAM, cables, connectors, power supply, software and information CD, which are critical for streamlining user interaction with the present invention. The use of other system boards will likely increase the burden on the end user and not provide the flexibility of the ARCOM development kit (www.arcom.com).

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An audio/video display system for playing back a prerecorded electronic file over extended periods of time at a cemetery, said display system comprising:

a stainless steel casing directly connected to an existing headstone positioned on a ground surface adjacent to a burial plot in the cemetery, said casing being nested within said headstone such that a front edge of said casing is mounted flush with a front face of said headstone, said casing having a substantially rectangular shape and being provided with a central opening formed therein;

a plurality of solar panels directly and permanently mounted on an exterior surface of said headstone, said solar panels being selectively spaced apart and positioned in such a manner that said solar panels face a projected path of daylight sun rays, said solar panels being disposed exterior of said casing;

a bullet proof shield directly conjoined to said casing and interfitted within said opening in such a manner that unauthorized access to an interior of said casing is prohibited;

a display screen disposed rearward of said shield and facing outwardly towards said front face of said headstone;

means for converting a solar energy input to an electrical energy output, said solar energy converting means being electrically coupled to said solar panels and housed within said casing;

a 12-volt rechargeable battery electrically coupled directly to said solar energy converting means so that said 12-volt rechargeable battery can be replenished with power during non-operating conditions;

means for converting a DC voltage input having a first voltage level to a DC voltage output having a second voltage level, said DC voltage level converting means being electrically coupled to said solar energy converting means and spaced from said 12-volt rechargeable battery such that said DC voltage level converting means is independently operable from said 12-volt rechargeable battery; and a system board electrically and directly coupled to said DC voltage level converting means, said system board including means for contemporaneously emitting an audio output and an associated video output based upon a prerecorded electronic file stored on said system board;

wherein said display system is weatherproof and bullet proof for preventing unauthorized access;

wherein each of said bullet proof shield and said display screen are located inside said casing;

wherein said system board is located exterior of said casing.

2. The system of claim 1, wherein said stainless steel casing comprises:

a first section positioned forward of said bullet proof shield; and a second section detachably positioned rearward of said DC voltage level converting means, said second section having a central opening formed therein and being provided with a bracket directly mounted to an inner perimeter of the opening for receiving and supporting said system board at an elevated position.

3. The system of claim 1, wherein said system board comprises:

a processor;

an audio and video playback device embedded on an architecture of said system board and electrically coupled to said processor; and a memory electrically coupled to said processor, said memory including software instructions that causes said display system to selectively play back said prerecorded electronic file as desired by a user, said software instructions executing the steps of a. identifying an input signal received from an external user input, b. generating and sending a first control signal to said audio and video playback device such that said prerecorded electronic file is caused to play on demand; and c. generating and sending a second control signal to said solar energy converting means such that an energy supply source can be regulated when the user desires to turn off said audio and video playback device.

4. The system of claim 1, wherein said DC voltage level converting means comprises: a DC-to-DC controller which converts a 12-volt input signal to a 5-volt output signal for powering said system board and said LCD panel respectively.

5. An audio/video display system for playing back a prerecorded electronic file over extended periods of time at a cemetery, said display system comprising:

a stainless steel casing directly connected to an existing headstone positioned on a ground surface adjacent to a burial plot in the cemetery, said casing being nested within said headstone such that a front edge of said casing is mounted flush with a front face of said headstone, said casing having a substantially rectangular shape and being provided with a central opening formed therein;

a plurality of solar panels directly and permanently mounted on an exterior surface of said headstone, said solar panels being selectively spaced apart and positioned in such a manner that said solar panels face a projected path of daylight sun rays, said solar panels being disposed exterior of said casing;

a bullet proof shield directly conjoined to said casing and interfitted within said opening in such a manner that unauthorized access to an interior of said casing is prohibited;

a display screen disposed rearward of said shield and facing outwardly towards said front face of said headstone;

means for converting a solar energy input to an electrical energy output, said solar energy converting means being electrically coupled to said solar panels and housed within said casing;

a 12-volt rechargeable battery electrically coupled directly to said solar energy converting means so that said 12-volt rechargeable battery can be replenished with power during non-operating conditions;

means for converting a DC voltage input having a first voltage level to a DC voltage output having a second voltage level, said DC voltage level converting means being electrically coupled to said solar energy converting means and spaced from said 12-volt rechargeable battery such that said DC voltage level converting means is independently operable from said 12-volt rechargeable battery;

a system board electrically and directly coupled to said DC voltage level converting means, said system board including means for contemporaneously emitting an audio output and an associated video output based upon a prerecorded electronic file stored on said system board;

wherein said display system is weatherproof and bullet proof for preventing unauthorized access; and a plurality of speakers nested within said headstone and electrically coupled to said DC voltage level converting means;

wherein each of said bullet proof shield and said display screen are located inside said casing;

wherein said system board is located exterior of said casing.

6. The system of claim 5, wherein said stainless steel casing comprises:

a first section positioned forward of said bullet proof shield; and a second section detachably positioned rearward of said DC voltage level converting means, said second section having a central opening formed therein and being provided with a bracket directly mounted to an inner perimeter of the opening for receiving and supporting said system board at an elevated position.

7. The system of claim 5, wherein said system board comprises:

a processor;

an audio and video playback device embedded on an architecture of said system board and electrically coupled to said processor; and a memory electrically coupled to said processor, said memory including software instructions that causes said display system to selectively play back said prerecorded electronic file as desired by a user, said software instructions executing the steps of a. identifying an input signal received from an external user input, b. generating and sending a first control signal to said audio and video playback device such that said prerecorded electronic file is caused to play on demand; and c. generating and sending a second control signal to said solar energy converting means such that an energy supply source can be regulated when the user desires to turn off said audio and video playback device.

8. The system of claim 5, wherein said DC voltage level converting means comprises: a DC-to-DC controller which converts a 12-volt input signal to a 5-volt output signal for powering said system board and said LCD panel respectively.

9. An audio/video display system for playing back a prerecorded electronic file over extended periods of time at a cemetery, said display system comprising:

a stainless steel casing directly connected to an existing headstone positioned on a ground surface adjacent to a burial plot in the cemetery, said casing being nested within said headstone such that a front edge of said casing is mounted flush with a front face of said headstone, said casing having a substantially rectangular shape and being provided with a central opening formed therein;

a plurality of solar panels directly and permanently mounted on an exterior surface of said headstone, said solar panels being selectively spaced apart and positioned in such a manner that said solar panels face a projected path of daylight sun rays, said solar panels being disposed exterior of said casing;

a bullet proof shield directly conjoined to said casing and interfitted within said opening in such a manner that unauthorized access to an interior of said casing is prohibited, wherein said bullet proof shield is adhesively connected to said casing;

a display screen disposed rearward of said shield and facing outwardly towards said front face of said headstone;

means for converting a solar energy input to an electrical energy output, said solar energy converting means being electrically coupled to said solar panels and housed within said casing;

a 12-volt rechargeable battery electrically coupled directly to said solar energy converting means so that said 12-volt rechargeable battery can be replenished with power during non-operating conditions;

means for converting a DC voltage input having a first voltage level to a DC voltage output having a second voltage level, said DC voltage level converting means being electrically coupled to said solar energy converting means and spaced from said 12-volt rechargeable battery such that said DC voltage level converting means is independently operable from said 12-volt rechargeable battery;

a system board electrically and directly coupled to said DC voltage level converting means, said system board including means for contemporaneously emitting an audio output and an associated video output based upon a prerecorded electronic file stored on said system board;

wherein said display system is weatherproof and bullet proof for preventing unauthorized access; and a plurality of speakers nested within said headstone and electrically coupled to said DC voltage level converting means;

wherein each of said bullet proof shield and said display screen are located inside said casing;

wherein said system board is located exterior of said casing.

10. The system of claim 9, wherein said stainless steel casing comprises:

a first section positioned forward of said bullet proof shield; and a second section detachably positioned rearward of said DC voltage level converting means, said second section having a central opening formed therein and being provided with a bracket directly mounted to an inner perimeter of the opening for receiving and supporting said system board at an elevated position.

11. The system of claim 9, wherein said system board comprises:

a processor;

an audio and video playback device embedded on an architecture of said system board and electrically coupled to said processor; and a memory electrically coupled to said processor, said memory including software instructions that causes said display system to selectively play back said prerecorded electronic file as desired by a user, said software instructions executing the steps of a. identifying an input signal received from an external user input, b. generating and sending a first control signal to said audio and video playback device such that said prerecorded electronic file is caused to play on demand; and c. generating and sending a second control signal to said solar energy converting means such that an energy supply source can be regulated when the user desires to turn off said audio and video playback device.

12. The system of claim 9, wherein said DC voltage level converting means comprises: a DC-to-DC controller which converts a 12-volt input signal to a 5-volt output signal for powering said system board and said LCD panel respectively.

* * * * *